US005835063A

United States Patent [19]

Brachat et al.

[11] Patent Number: 5,835,063

[45] Date of Patent: Nov. 10, 1998

[54] MONOPOLE WIDEBAND ANTENNA IN UNIPLANAR PRINTED CIRCUIT TECHNOLOGY, AND TRANSMISSION AND/OR RECREPTION DEVICE INCORPORATING SUCH AN ANTENNA

[75] Inventors: Patrice Brachat; Christian Sabatier, both of Nice; Roger Behe, La Turbie, all of France

[73] Assignee: France Telecom, France

[21] Appl. No.: 941,178

[22] Filed: Sep. 30, 1997

Related U.S. Application Data

[63] Continuation of Ser. No. 559,244, Nov. 16, 1995, abandoned.

[30] Foreign Application Priority Data

Nov. 22, 1994 [FR] France ..... 94 14198

[51] Int. Cl.[6] ..... H01Q 1/38

[52] U.S. Cl. ..... 343/700 MS; 343/702; 343/846

[58] Field of Search ..... 343/700 MS, 702, 343/803, 846, 795

[56] References Cited

U.S. PATENT DOCUMENTS

| | | | |
|---|---|---|---|
| 4,084,162 | 4/1978 | Dubost et al. | 343/700 MS |
| 4,157,548 | 6/1979 | Kaloi | 343/700 MS |
| 4,426,649 | 1/1984 | Dubost et al. | 343/803 |
| 4,825,220 | 4/1989 | Edward et al. | 343/795 |
| 5,410,323 | 4/1995 | Kuroda | 343/700 MS |
| 5,539,414 | 7/1996 | Keen | 343/803 |

FOREIGN PATENT DOCUMENTS

| | | |
|---|---|---|
| A-0604338 | 6/1994 | European Pat. Off. . |
| A-2709604 | 10/1995 | France . |

*Primary Examiner*—Hoanganh T. Le
*Assistant Examiner*—Tan Ho
*Attorney, Agent, or Firm*—Kinney & Lange, P.A.

[57] ABSTRACT

An antenna for the transmission and/or reception of microwave signals comprises a substrate plate, at least one feeder line located on a first face of the substrate plate and a conductive deposit located on a second face of the substrate plate. The conductive deposit defines a main surface forming a ground plane for the feeder line and at least one radiating finger. The radiating finger has a first end connected to the main surface and a free end extending at least partially along one side of the main surface to form a longitudinal space between the radiating finger and the main surface. The longitudinal space forms a coupling slot for the antenna.

11 Claims, 3 Drawing Sheets

MONOPOLE WIDEBAND ANTENNA IN UNIPLANAR PRINTED CIRCUIT TECHNOLOGY, AND TRANSMISSION AND/OR RECREPTION DEVICE INCORPORATING SUCH AN ANTENNA

This is a continuation of application Ser. No. 08/559,244, filed Nov. 16, 1995, now abandoned.

BACKGROUND OF THE INVENTION

1. Field of the Invention

The field of the invention is that of RF transmission. More specifically, the invention relates to transmission and/or reception antennas, especially for small-sized equipment such as portable devices.

The invention can thus be applied especially to systems of radiocommunication with moving bodies. Indeed, the growth of networks for radiocommunication with earth-based moving bodies is making it necessary to devise and develop independent portable stations having the twofold functions of transmitting and receiving microwave signals. These stations should therefore include integrated antennas.

2. Description of the Prior Art

The frequencies presently used for these applications (in the range of 2 GHz) as well as the different constraints related to the ergonomic and aesthetic quality of the communications sets (pertaining to the integration of the antenna into the design of the instrument, ease of storage and use, fragility of large-sized antennas, etc.) are leading to the use of very small-sized antennas. Thus, there are several known types of antennas whose dimensions are smaller than the wavelength of the microwave signal.

These antennas generally take the shape of a radiating element implanted on the exterior of a metal casing which is for example parallelepiped-shaped. This casing shields one or more electronic boards that fulfil, in particular, the functions of the modulation and demodulation of microwave signals in transmission and reception respectively.

A first type of known antenna is the half-wave dipole, namely a dipole with a wavelength $\lambda/2$ with $\lambda$ as the operating wavelength.

The half-wave dipole, which is generally formed by twin conductor elements (namely conductive cylindrical rods) supplied by a feeder line, has relatively wideband performance characteristics making it capable of being used in many applications.

However, several drawbacks are related to its use. Indeed, the feeder lines (for example coaxial lines) are generally unbalanced whereas the radiating elements are balanced. Consequently, in order that the radiation of the half-wave dipole may be acceptable, it is necessary to use a balun. A balun conventionally takes the form of a transformer that brings into play localized or distributed impedances and makes it possible, when it is placed between a balanced radiating element and a unbalanced feeder line, to balance the currents on the radiating structure. A balun such as this has the major drawback of requiring a setting operation that is always difficult.

There also exists known half-wave dipoles that are self-balanced so that they can be used without a balun. However, owing to the use of conductive cylindrical rods, a self-balancing characteristic such as this can be obtained only at the cost of the increased complexity of the structure of the antenna.

Finally, in a general way, the half-wave dipoles with cylindrical rods are difficult to handle mechanically and at the same time take up an amount of space that is still far too great (although limited), the minimum length of the antenna being dictated by the length of the main strands, namely about $\lambda/2$.

As specified here above, the reduction of the amount of space required has become an essential aim of antenna designers.

A second type of antenna, which is even more compact than the half-wave dipole, has therefore been designed. This is the inverted F antenna formed by a horizontal rectangular conductor element and a vertical rectangular conductor element. The vertical element fulfils a short-circuit function on the horizontal element by connecting one of its ends to a ground plane. The length of the horizontal element is generally $L=\lambda/4$. In other words, the horizontal element is placed in a plane parallel to the ground plane and at a height h with respect to this ground plane.

Thus, for frequencies in the range of 2 GHz, these dimensions are in the range of some centimeters. The antenna obtained is therefore very compact (its minimum length is $\lambda/4$ instead of $\lambda/2$ for the half-wave dipole).

By contrast, this antenna has characteristics that vary greatly in terms of frequency and, consequently, has a very low passband, for example of the order of 2% to 3%. This is due to the fact that this antenna structure behaves substantially like a $\lambda/4$ resonator.

The passband of an antenna is herein defined as the frequency band in which the standing wave ratio (SWR) is smaller than 2. The SWR represents the capacity of the antenna to transmit the active power given to it. This is the most critical factor for small-sized antennas.

This variable is directly related to the input impedance of the antenna which has to be matched with the impedance of the transmission line conveying the microwave signal to be transmitted and/or to be received. For the optimum operation of the antenna, this impedance has to remain substantially constant (namely the SWR should remain smaller than 2, an SWR equal to 1 corresponding to perfect matching) over a wide frequency band. A passband of 2% to 3% as obtained by means of an inverted F antenna is generally insufficient.

The invention is especially aimed at overcoming the drawbacks of the different known types of antenna and especially those of half-wave dipoles and inverted F antennas.

More specifically, an aim of the invention is to provide an antenna which is compact and has a wide passband. Thus, the invention is aimed in particular at providing such an antenna, the passband of which is at least in the range of 20% to 30% and takes up a limited amount of space, especially as compared with an inverted F antenna.

The invention is also aimed at providing a self-balanced antenna, hence one that does not need any balun.

Yet another aim of the invention is to provide such an antenna capable of working over a wide range of input impedances and especially for input impedances of 10 to 200 Ω.

SUMMARY OF THE INVENTION

These aims, as well as others that shall appear hereinafter, are achieved according to the invention by means of an antenna for the transmission and/or reception of microwave signals comprising:

a substrate plate;

at least one feeder line located on a first face of said substrate plate;

a conductive deposit located on a second face of said substrate plate so as to define:

a main surface forming a ground plane for said feeder line;

at least one radiating finger having a first end connected to said main surface and a second free end extending at least partially along at least one side of said main surface;

at least one longitudinal space forming a coupling slot between each of said radiating fingers and said main surface.

The antenna of the invention is therefore made by printed circuit technology thus enabling a considerable gain in space and making it far easier to hold mechanically.

Furthermore, the main surface of the conductive deposit, in forming a ground plane for the feeder line, ensures that the supply is self-balanced. In other words, the antenna according to the invention does not require the use, in conjunction, of a balun The feeder line supplies the radiating finger by means of the coupling slot.

The antenna according to the invention relies especially on a novel and inventive adaptation of the inverted F antenna. The 2D configuration of the inverted F antenna has been projected in a single plane containing the entire antenna. In other words, the radiating finger and the ground plane are no longer in two distinct parallel planes but in one and the same plane. As compared with the inverted F antenna, the antenna of the invention is therefore far more compact since it removes the need for the height h between the radiating finger (or the horizontal conductive element) and the ground plane.

Furthermore, the antenna of the invention has a far wider passband than that of the inverted F antenna. This can be explained especially by the fact that, for the inverted F antenna, the radiating finger is located just above the ground plane and forms a cavity, with this ground plane, that is highly selective in frequencies (generally 2% to 3% of the passband). By contrast, in the case of the invention, the ground plane and the radiating finger are located in one and the same plane so that the cavity effect is far less marked. This makes it possible to obtain bandwidths close to 25% and to cover the transmission band and the reception band simultaneously.

Advantageously, said feeder line and said coupling slot intersect at a point called a point of intersection, said feeder line having an end portion, or series stub, that extends beyond said point of intersection by a first adaptable length and said coupling slot having an end portion, or parallel stub, extending beyond said point of intersection by a second adaptable length.

Thus, it is possible to implement the known principle of double (series and parallel) matching. An appropriate choice of these series and parallel stubs and, as the case may be, of other parameters (width of radiating finger, width of coupling slot, thickness of the conductive deposit linking part that connects the radiating finger to the main surface, position of the feeder line with respect to the conductive deposit linking part) enables the antenna to be matched with a wide passband.

Preferably, with at least one of the elements belonging to the group comprising said radiating finger, said main surface and said coupling slot is substantially rectangular.

Advantageously, said conductive deposit has at least two radiating fingers, the longitudinal space between each of said radiating fingers and said main surface forming a distinct coupling slot.

Thus, it is possible to obtain:

a diversity of polarization, in associating the feeder line with a divider;

a circular polarization, in associating the feeder line with dividers and phase-shifters.

Advantageously, the antenna has at least two feeder lines, each of said radiating fingers cooperating with one of said feeder lines.

In this way, it is possible to obtain a duplexed multiple-band antenna.

Preferably, said radiating finger has at least one elbow, so that said radiating finger extends at least partially along at least two sides of said main surface.

In this way, the overall space requirement of the antenna is limited since the minimum dimension of the antenna is no longer related to the total length of the radiating finger but only to the length of the sides of the main surface of the conductive deposit.

Preferably, said radiating finger has a variable width. Thus, the passband of the antenna is increased.

Advantageously, said radiating finger has at least one stepped feature on at least one of the longitudinal edges and/or at least one aperture on its surface. The aperture on the surface of the radiating finger is, for example, a slot.

Preferably, said feeder line has an impedance substantially ranging from 10 Ω to 200 Ω.

Advantageously, the length of said radiating finger substantially ranges from $\lambda/8$ to $\lambda/4$, $\Lambda$ being the wavelength of said microwave signals.

The invention also relates to a device for the transmission and/or reception of microwave signals comprising at least one antenna such as the one described here above.

BRIEF DESCRIPTION OF THE DRAWINGS

Other features and advantages of the invention shall appear from the following description of several preferred embodiments of the invention, given by way of a non-restrictive example, and from the appended drawings of which.

MORE DETAILED DESCRIPTION

The invention therefore relates to a small-sized antenna with a wide passband. This antenna is designed in particular to be fitted into portable devices, for example transceivers of networks for radiocommunication with earth-based moving bodies.

Figure 1A:
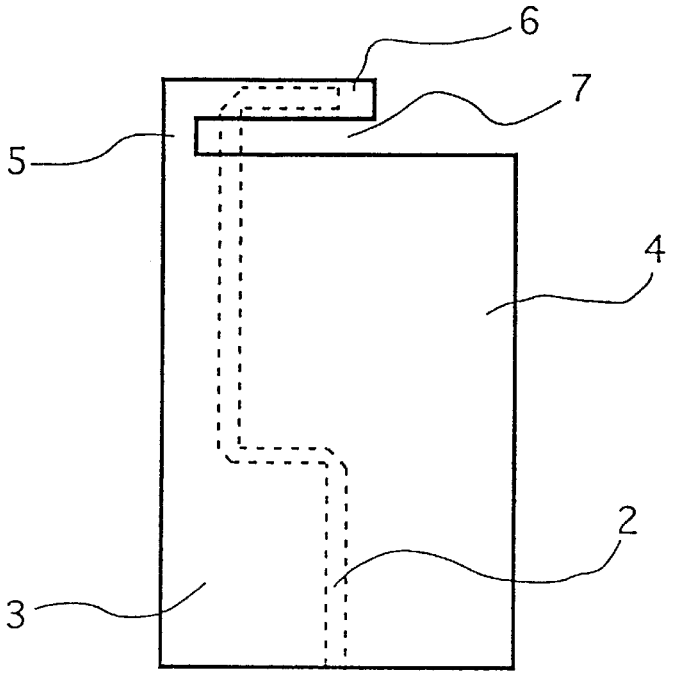
FIGS. 1A and 1B each show a top view and a side view respectively of a first embodiment of an antenna according to the invention.
Figure 1B:
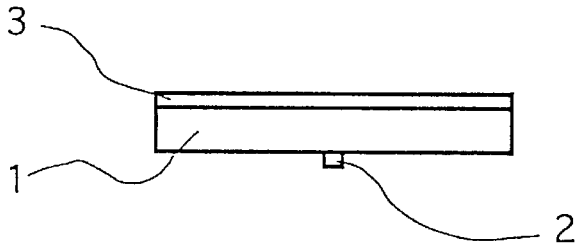

FIGS. 1A and 1B which are respectively a top view and a side view illustrate a first embodiment of the invention.

In this embodiment, the antenna has a substrate plate 1, a feeder line 2 and a conductive deposit 3.

The substrate plate 1 is, for example, a low-loss Duroid substrate of the Teflon glass type having a relative permittivity EPSILON$_r$=2.2 and a limited thickness of 0.76 mm.

The feeder line 2 is located on a first face (the lower face for example) of the substrate plate 1. It is, for example, a microstrip line.

The conductive deposit 3, which is a deposit of copper for example, is located on the second face (the upper face for example) of the substrate plate 1 and may be divided (fictitiously because in practice it is made out of a single piece) into three parts : a main surface 4, an intermediate part 5 and a radiating finger 6.

The main surface 4 (which is rectangular in this example) of the conductive deposit 3 forms a ground plane for the feeder line 2 located on the other face of the substrate plate 1. The antenna therefore generates balanced currents on the radiating finger 6. In other words, the antenna of the invention is self-balanced.

In this example, the radiating finger 6 is rectangular and has a first end connected to the main surface 4 of the conductive deposit 3 by the intermediate part 5 and a second free end extending partially along one side of the main surface 4 of the conductive deposit 3.

The length of the radiating finger 6 is close to $\lambda/4$ with $\lambda$ as the operating wavelength of the antenna.

Thus, the antenna of the invention which is flat and whose maximum length is $\lambda/4$, takes up less space than a dipole with a length $\lambda/2$ or again less space than an inverted F antenna with a length $\lambda/4$, but its radiating finger is at a height h from the ground plane.

The antenna of the invention is not only very compact but also has a very wide passband. Indeed, the main surface 4 of the conductive deposit 3 behaves like a ground plane especially with respect to the feeder line 2 and the coupling slot 7, and does so to a very small extent with respect to the radiating finger 6. This greatly diminishes the selectivity of the antenna. Furthermore, the cavity effect (and hence the selectivity of the antenna) is far less marked than it is for an inverted F antenna since the ground plane (namely the main surface 4 of the conductive deposit 3) and the radiating finger 6 are located in one and the same plane.

Generally, the antenna according to the invention has a passband of 20% to 30% and may be easily incorporated within an ultra-light portable set.

The longitudinal space between the radiating finger 6 and the main surface 4 of the conductive deposit 3 forms a coupling slot 7 by means of which the feeder line supplies the radiating finger 6.

In the example shown in FIG. 1A, the coupling slot 7 is also rectangular.

Figure 2:
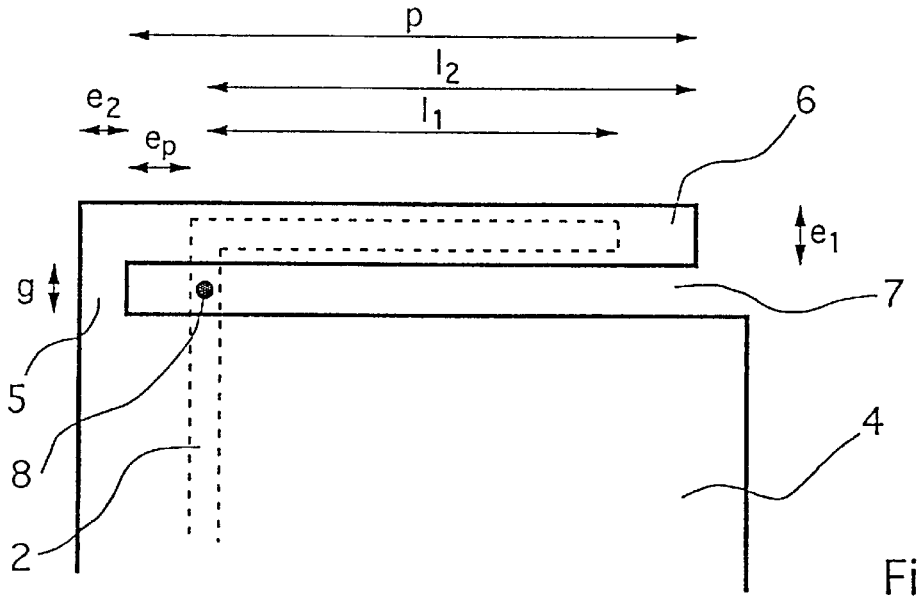
FIG. 2 shows a detailed partial view of the antenna shown in FIG. 1A.

FIG. 2 shows a detailed partial view of the antenna shown in FIG. 1A.

In order to set the antenna and adjust its bandwidth in particular, several parameters may be modified, especially:

the length $l_1$ of a series stub, the series stub being the end portion of the feeder line 2 which goes beyond the point of intersection 8 between the feeder line 2 and the coupling slot 7;

the length $l_2$ of a parallel stub, the parallel stub being the end portion of the coupling slot 7 that goes beyond the point of intersection 9;

the width $e_1$ of the radiating finger 6;

the depth p of the coupling slot 7;

the width g of the coupling slot 7;

the thickness $e_2$ of the intermediate part 5 connecting the radiating finger 6 to the main surface 4;

the distance $e_p$ between the feeder line 2 and the intermediate part 5.

Thus, although it is made by printed circuit technology, the antenna of the invention has a series stub and a parallel stub. These series and parallel stubs enable the matching of the antenna according to the known principle of double stub matching, with a wide band of frequencies.

Figure 3:
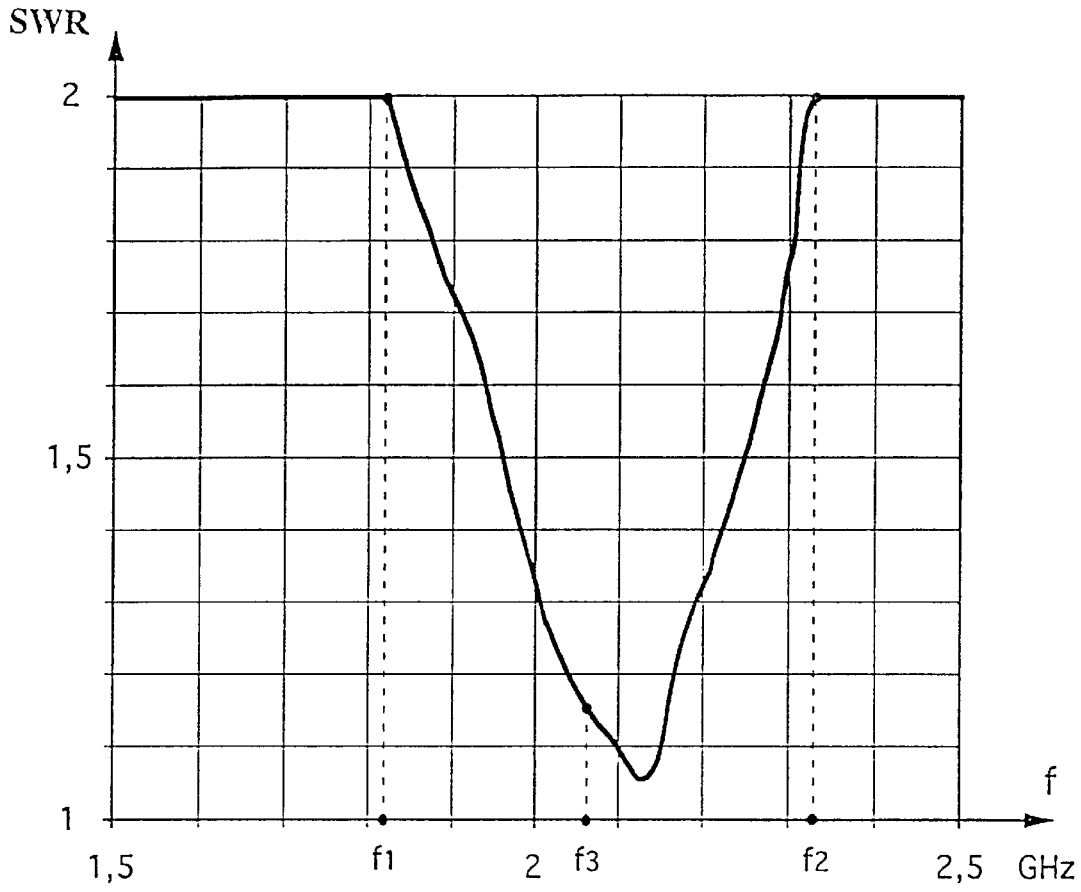
FIG. 3 shows a curve of variation as a function of frequency of the standing wave ratio for an exemplary antenna according to the invention.

FIG. 3 shows a curve of variation, as a function of the frequency, of the standing wave ratio (or SWR) for an exemplary antenna according to the first embodiment of FIGS. 1A and 2.

In this example, the parameters of the antenna have the following values:

$l_1$=13 mm;

$l_2$=22.6 mm;

$e_1$=5 mm;

$e_2$=6 mm;

g=5mm;

$e_p$=1.65 mm;

p=24.25 mm.

This curve enables the computation of the passband (f1, f2), herein defined as the frequency band for which the SWR remains below 2. This passband may also be expressed in terms of percentage obtained by the division of the width (f2, f1) of the passband for a central frequency f3 of this band.

In the above-mentioned example, the passband is substantially between f1=1.823 GHz and f2=2.333 GHz.

With a central frequency f3=2.078 GHz, this passband is approximately equal to 25%. The antenna according to the invention therefore has a passband wide enough to cover the transmission band and the reception band simultaneously.

Figure 4:
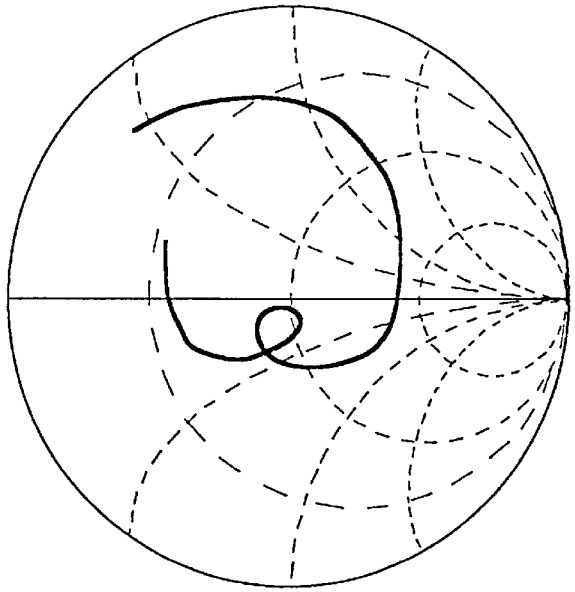
FIG. 4 is a Smith chart showing a curve of impedance corresponding to an exemplary antenna according to the invention.

FIG. 4 shows a curve of variation, in a Smith chart, of the input impedance for the above example of an antenna. The figure shows the presence of a loop around the center of the chart (which is the perfect matching point with respect to a 50 Ω feeder line). This loop ensures a small variation in frequency and expresses the efficiency of the matching.

It must be noted however that, in this example, the antenna is not perfectly optimized. Indeed, an improved centering of the loop with respect to the center of the Smith chart would enable the performance characteristics of the antenna to be increased.

In this example, the impedance of the feeder line conveying the high frequency signal to be transmitted has been fixed at 50 Ω but this value is not a determining characteristic for the input impedance of the antenna according to the invention may have any value from 10 to 200 Ω.

Figure 5:
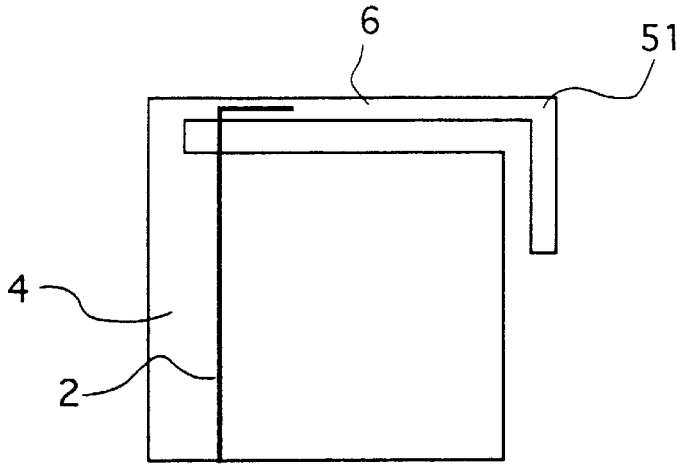
FIGS. 5, 6 and 7 each show a top view of a distinct embodiment (the second, third and fourth embodiments respectively) of an antenna according to the invention.

FIG. 5 shows a top view of a second embodiment of the antenna according to the invention. This second embodiment is differentiated from the first one in that the radiating finger 6 has an elbow 51 and extends along two sides of the main surface 4 of the conductive deposit 3. Thus, the overall space requirement of the antenna is further reduced. If the length of the radiating finger 6 is equal to $\lambda/4$ it is possible, by creating an elbow 51 at half-length, to obtain dimensions close to Ω/8. It is clear that the elbow 51 is not necessarily at the center of the radiating finger 6 or again that the radiating finger 6 may have more than one elbow so as to extend along more than two sides of the main surface 4.

Figure 6:
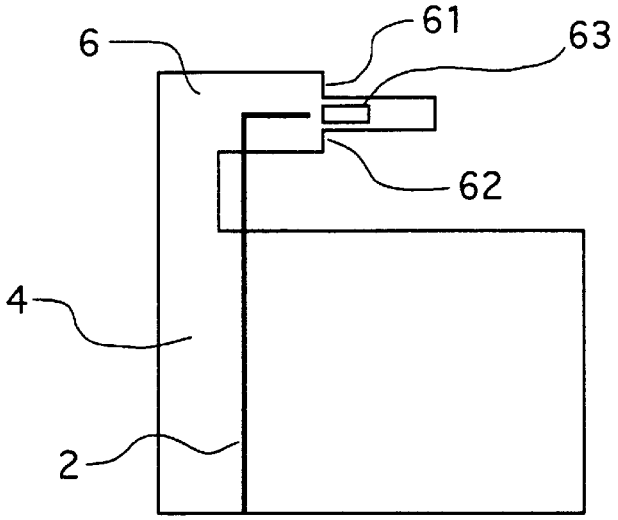

FIG. 6 shows a top view of a third embodiment of the antenna according to the invention. This third embodiment is differentiated from the first one by the fact that the radiating finger 6 has a width that is variable along its length. This variable width, when it is appropriately chosen, enables the passband of the antenna to be increased. In the example shown in FIG. 6, the radiating finger 6 has a stepped feature 61, 62 on each of its longitudinal edges. It must be noted that in other embodiments, the radiating finger 6 may have a slot 63 in its middle or may have several stepped features on each of its longitudinal edges or again may have one or more stepped features on only one of its longitudinal edges.

Figure 7:
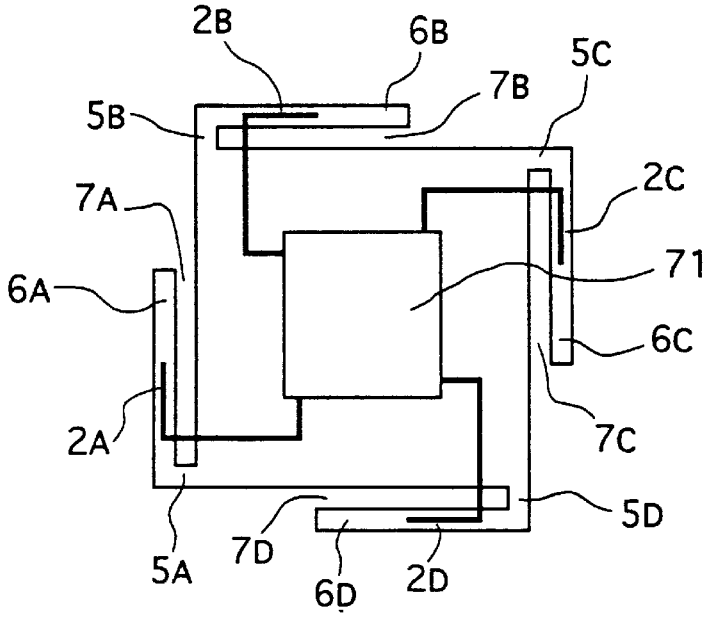

FIG. 7 shows a top view of a fourth embodiment of the antenna according to the invention. In this fourth embodiment, the antenna has several radiating fingers $\mathbf{6}_A$, $\mathbf{6}_B$, $\mathbf{6}_C$, $\mathbf{6}_D$ (four in this example). Each radiating finger $\mathbf{6}_A$, $\mathbf{6}_B$, $\mathbf{6}_C$, $\mathbf{6}_D$ is connected to the main surface 4 by an intermediate part $\mathbf{5}_A$, $\mathbf{5}_B$, $\mathbf{5}_C$, $\mathbf{5}_D$ and each longitudinal space between a radiating finger $\mathbf{6}_A$, $\mathbf{6}_B$, $\mathbf{6}_C$, $\mathbf{6}_D$ and the main surface 4 forms a distinct coupling slot $\mathbf{6}_A$, $\mathbf{6}_B$, $\mathbf{6}_C$, $\mathbf{6}_D$.

Depending on the application, the radiating fingers $\mathbf{6}_A$, $\mathbf{6}_B$, $\mathbf{6}_C$, $\mathbf{6}_D$ may be identical or not identical.

Similarly, a single feeder line may supply all the radiating fingers $\mathbf{6}_A$, $\mathbf{6}_B$, $\mathbf{6}_C$, $\mathbf{6}_D$ or else several feeder lines may be used. Thus, by increasing the number of feeder lines and by associating each of the radiating fingers with a distinct feeder line, it is possible to obtain a duplexed multiple-band antenna.

In the example shown in FIG. 7, the antenna has means 71 for shaping the HF signals received from a main feeder line (not shown) and having to be transmitted on the different secondary feeder lines $\mathbf{2}_A$, $\mathbf{2}_B$, $\mathbf{2}_C$, $\mathbf{2}_D$ associated with the different radiating fingers $\mathbf{6}_A$, $\mathbf{6}_B$, $\mathbf{6}_C$, $\mathbf{6}_D$.

These means 71 can be used to obtain:

either the diversity of linear polarization if the means 71 comprise a divider;

or circular polarization if the means 71 comprise dividers and phase shifters.

The elements (dividers, phase shifters) forming the signal-shaping means 71 may be constituted by different lengths of feeder lines, hybrid rings or again by the use of any other approach that is known to those skilled in the art and that fulfils the desired function.

The invention also relates to any device for the transmission and/or reception of microwave signals fitted out with an antenna according to the invention. If necessary, such a device may include several antennas and, especially, a transmission antenna and a reception antenna.

What is claimed is:

1. An antenna having an approximately omnidirectional radiating pattern, for the transmission and/or reception of microwave signals, said antenna comprising:

a substrate plate;

at least one feeder line located on a first face of said substrate plate;

a conductive deposit located on a second face of said substrate plate so as to define:

a main surface forming a ground plane for said feeder line;

at least one monopole radiating finger having a first end connected to and extending from said main surface and a second free end extending at least partially along at least one side of said main surface, no condition of symmetry being imposed on said monopole radiating finger, said main surface forming a ground plane also for said monopole radiating finger;

each monopole radiating finger being associated to a distinct coupling slot formed by a longitudinal space between said monopole radiating finger and said main surface.

2. An antenna according to claim 1, wherein said feeder line and said coupling slot intersect at a point of intersection, said feeder line has an end portion, or series stub, that extends beyond said point of intersection by a first adaptable length, and said coupling slot has an end portion, or parallel stub, extending beyond said point of intersection by a second adaptable length.

3. An antenna according to claim 1, wherein, with at least one of the elements belonging to the group comprising said monopole radiating finger, said main surface and said coupling slot is substantially rectangular.

4. An antenna according to claim 1, wherein said conductive deposit has at least two monopole radiating fingers, the longitudinal space between each of said monopole radiating fingers and said main surface forming a distinct coupling slot.

5. An antenna according to claim 4, comprising at least two feeder lines, each of said monopole radiating fingers cooperating with one of said feeder lines.

6. An antenna according to claim 1, wherein said monopole radiating finger has at least one elbow so that said monopole radiating finger extends at least partially along at least two sides of said main surface.

7. An antenna according to claim 1, wherein said monopole radiating finger has a variable width.

8. An antenna according to claim 7, wherein said monopole radiating finger has at least one stepped feature on at least one of the longitudinal edges and/or at least one aperture on its surface.

9. An antenna according to claim 1, wherein said feeder line has an impedance substantially ranging from 10Ω to 200Ω.

10. An antenna according to claim 1, wherein the length of said monopole radiating finger substantially ranges from $\lambda/8$ to $\lambda/4$, $\lambda$ being the wavelength of said microwave signals.

11. A device for the transmission and/or reception of microwave signals comprising at least one according to claim 1.

* * * * *

UNITED STATES PATENT AND TRADEMARK OFFICE

CERTIFICATE OF CORRECTION

PATENT NO. : 5,835,063

DATED : NOVEMBER 10, 1998

INVENTOR(S) : PATRICE BRACHAT ET AL.

It is certified that error appears in the above-identified patent and that said Letters Patent is hereby corrected as shown below:

On the title page,

Under Item [54]: delete "RECREPTION", insert --RECEPTION--

Col. 1, in the title delete "RECREPTION", insert --RECEPTION--

Col. 6, line 56, delete "Ω", insert --λ—

Col. 8, line 49, after "at least one", insert --antenna—

Signed and Sealed this

Fourth Day of May, 1999

*Attest:*

*Attesting Officer*

Q. TODD DICKINSON

*Acting Commissioner of Patents and Trademarks*